US007946321B2

(12) United States Patent
Abe et al.

(10) Patent No.: US 7,946,321 B2
(45) Date of Patent: May 24, 2011

(54) METHOD OF HOLDING A VENEER SHEET

(75) Inventors: Yukio Abe, Aichi (JP); Makoto Isobe, Aichi (JP); Issaku Okamura, Aichi (JP); Hiroshige Oda, Aichi (JP); Akihito Hamaguchi, Aichi (JP); Noriyuki Honda, Aichi (JP)

(73) Assignee: Meinan Machinery Works, Inc., Obu-shi (JP)

( * ) Notice: Subject to any disclaimer, the term of this patent is extended or adjusted under 35 U.S.C. 154(b) by 392 days.

(21) Appl. No.: 11/790,287

(22) Filed: Apr. 24, 2007

(65) Prior Publication Data

US 2008/0264520 A1 Oct. 30, 2008

(51) Int. Cl.
*B27M 1/00* (2006.01)

(52) U.S. Cl. ..... 144/380

(58) Field of Classification Search ..... 144/362, 144/380, 381, 364, 344, 332; 34/144, 116, 34/155, 159, 380, 388, 391, 396, 442, 397, 34/398, 239; 156/157, 222, 304.1, 250, 254
See application file for complete search history.

(56) References Cited

U.S. PATENT DOCUMENTS

| | | | | | |
|---|---|---|---|---|---|
| 1,511,400 | A | * | 10/1924 | Daly | 34/396 |
| 1,573,379 | A | * | 2/1926 | Elmendorf | 34/380 |
| 1,578,020 | A | * | 3/1926 | Elmendorf | 34/389 |
| 3,160,413 | A | * | 12/1964 | Faeber | 271/188 |
| 3,545,094 | A | * | 12/1970 | Barnes et al. | 34/396 |
| 3,591,927 | A | * | 7/1971 | Schuette et al. | 34/541 |
| 3,761,080 | A | * | 9/1973 | Larson | 271/209 |
| 3,779,543 | A | * | 12/1973 | Hayes | 271/180 |
| 4,400,124 | A | * | 8/1983 | Greller | 414/790.2 |
| 4,442,876 | A | * | 4/1984 | Koike et al. | 144/2.1 |
| 4,465,539 | A | * | 8/1984 | Saihara et al. | 156/250 |
| 4,507,162 | A | * | 3/1985 | Iwamoto | 156/157 |
| 4,654,981 | A | * | 4/1987 | Grebe et al. | 34/114 |
| 4,738,035 | A | * | 4/1988 | Grebe et al. | 34/114 |
| 4,809,754 | A | * | 3/1989 | Barnes | 144/392 |
| 4,862,600 | A | * | 9/1989 | Cremona | 34/117 |
| 5,062,218 | A | * | 11/1991 | Weil | 34/114 |
| 5,143,792 | A | * | 9/1992 | Cramer et al. | 428/528 |
| 5,419,382 | A | * | 5/1995 | Thompson | 144/362 |
| 6,110,313 | A | * | 8/2000 | Ford | 156/212 |
| 6,213,010 | B1 | * | 4/2001 | Bolzoni | 100/312 |
| 6,581,300 | B1 | * | 6/2003 | Grebe et al. | 34/396 |

FOREIGN PATENT DOCUMENTS

| | | | |
|---|---|---|---|
| DE | 19525544 | C1 * | 10/1996 |
| JP | 59-212678 | | 12/1984 |
| JP | 2001-38705 | | 2/2001 |

OTHER PUBLICATIONS

Translation of DE19525544C1, cited foreign patent, USPTO, Aug. 18, 2010.*

* cited by examiner

*Primary Examiner* — Dana Ross
*Assistant Examiner* — Jennifer Chiang
(74) *Attorney, Agent, or Firm* — Kratz, Quintos & Hanson, LLP

(57) ABSTRACT

The present invention is directed to a method of holding a veneer sheet which has been dried to a moisture content lower than the fiber saturation point and also heated to a temperature higher than an ambient temperature of an environment where the veneer sheet is held. The veneer sheet is bent in such way that at least a part of the veneer sheet in the longitudinal section thereof along the grain direction is curved and the same veneer sheet in any transverse section thereof perpendicular to the grain direction is substantially straight. The veneer sheet held bent is held for a predetermined period of time.

8 Claims, 11 Drawing Sheets

METHOD OF HOLDING A VENEER SHEET

BACKGROUND OF THE INVENTION

The present invention relates generally to a method of holding a veneer sheet. More specifically, the invention relates to a method of holding a veneer sheet in such way that at least a part of the veneer sheet in its longitudinal section along the direction of the wood grain of the veneer sheet is curved so that, upon release of the holding, the veneer sheet assumes a shape that is suitable for movement on a veneer sheet conveyer.

Wood veneer is used extensively for manufacturing plywood, laminated veneer lumber (LVL) and other various wood composite products. Green, i.e. undried, veneer has a moisture content higher than the fiber saturation point and, therefore, it needs to be dried generally to a level of 5 to 10 percent that is suitable for bonding of veneer sheets with adhesive.

A typical hot-air dryer used for drying veneer is disclosed, e.g., in the Japanese Patent Application Publication S59-212678. As is obvious from the Publication, veneer sheets which have come out successively from the dryer are laid one on another in the form of a stack of veneer sheets on a flat rigid support plate before they are delivered to any subsequent station. When the stack of veneer sheets has reached a predetermined height, it is just moved to a storage room. Alternatively, the stack may be placed on another veneer sheet stack with support blocks or timber interposed therebetween before they are moved to the storage room. It is noted that, if adhesive is applied to the surface of a veneer sheet which has jut been dried and hence still hot, the adhesive may be cured before veneer sheets are laid one on another for bonding, so that glued lamination cannot be achieved properly. Therefore, the purpose of such storage of just dried veneer sheets is to allow them to dissipate the heat and to be cooled to a level suitable for adhesive application on their surfaces.

For better understanding of the background of the invention, as well as the present invention per se, the length or longitudinal extent of a veneer sheet will refer to a dimension as measured in the general grain direction of the veneer sheet, while the width thereof to a dimension as measured in the direction that is perpendicular or transverse to the general grain direction.

It is known among those skilled in the art that a problem occurs during the storage of veneer sheets. When a veneer sheet is dried, it will shrink remarkably specifically in its transverse direction that is perpendicular to the direction of grain or wood fibers. Though the grain of a veneer sheet is oriented generally in the longitudinal direction of the veneer sheet, the individual wood fibers extend in various three-dimensional directions in a precise sense, so that the actual extent and direction of the shrinkage vary depending on individual different locations in a veneer sheet. Consequently, as the veneer sheet is shrunk after drying, various strains occur on both surfaces of the veneer sheet in various forms such as cupping or a bend of veneer sheet as viewed in its transverse section across the grain, waves or a succession of plural bends in the same transverse section, a longitudinal bend or a bend of veneer sheet as seen in its longitudinal direction along the grain, etc. Veneer sheets which have just come out of a dryer still have heat, so that the drying of the veneer sheets is continued by such residual heat and, therefore, shrinkage of the veneer sheets continues to occur even after the drying has been completed. The manner or direction in which a veneer sheet is bent or curved varies depending on the condition of wood fibers and the distribution of moisture in the veneer before drying and other various factors.

When veneer sheets are laid one veneer sheet on another into the form of a stack, those veneer sheets which are located in lower part of the stack receive the weight of the veneer sheets disposed thereabove and, therefore, the strains in veneer sheets in the lower part of the stack tend to be relieved by the weight and the shrinkage to be caused by the residual heat tends to be prevented by increased frictional force acting between any two adjacent veneer sheets due to the weight of the superimposed veneer sheets. On the other hand, however, those veneer sheets which are laid in upper part of the stack receive less weight and the frictional force between any two adjacent sheets is less, so that their strains will not be relieved and they tend to shrink easily and hence to be bent or warped.

For example, when a veneer sheet 10 whose leading end is bent downward is fed longitudinally on a roll conveyer 5 having a number of rolls 5*a* rotated in arrow direction and guide plates 5*b* between any two adjacent rolls 5*a*, with the grain of the veneer sheet 10 parallel to the direction in which the veneer sheet 10 is moved in arrow direction, as shown in FIG. 11, a problem will occur as will be explained below. In such longitudinal feeding, the leading end of the veneer sheet 10 is brought into such a troublesome contact with a roller 5*a* as shown in the drawing that may cause a failure in conveying of the veneer sheet 10. Though not shown in the drawing, if the veneer sheet 10 has its leading end bent upward when it is placed on the roll conveyer 5, the veneer sheet 10 is subjected to significant air resistance when it is moved at a rapid speed which causes the veneer sheet 10 to be lifted off from the rolls 5*a*, with the result that the veneer sheet 10 swerves from its normal course of movement in either direction, hitting against part of the roll conveyer 5. Thus, the veneer sheet 10 is prevented from being moved by the conveyer 5 with smoothness and stability.

Such troubles in conveying a veneer sheet may be alleviated to some extent by turning the veneer sheet upside down on the conveyer 5 as required depending on the extent and direction of the bend, but manner in which the veneer sheet is bent varies unpredictably from one veneer sheet to another. Therefore, it is not practical to previously set all veneer sheets of a stack in a specific position at the infeeding side of a conveyer. A workman may check visually each veneer sheet and turn by hand any veneer sheet upside down if it is found necessary by the workman to do so, but such work is a time-consuming and laborious.

If a wavy veneer sheet having a transverse bend is pressed flat during the gluing and laminating process, it is expanded transversely or split, with the result that the accuracy of laying of veneer sheets for lamination thereof may be lowered or a gap or overlapped sheets may occur in the lamination.

SUMMARY OF THE INVENTION

The present invention has been made in view of the above drawbacks and, therefore, an object of the present invention is to provide a method of holding a veneer sheet in a bent state so that, upon release from the holding, it will assume a shape suitable for movement on a conveyer.

In order to achieve the object, the present invention provides a method of holding a veneer sheet which has been dried to a moisture content lower than the fiber saturation point and also heated to a temperature higher than an ambient temperature of an environment where the veneer sheet is held. The veneer sheet for holding according to the present invention has a length along the grain direction thereof and a width transverse to the grain direction. The method of holding of the invention comprises bending the veneer sheet in such way that at least a part of the veneer sheet in the longitudinal section thereof along the grain direction is curved and the veneer sheet in any transverse section thereof perpendicular to the grain direction is substantially straight, and holding the veneer sheet in the bent state for a predetermined period of time.

The veneer sheet after being released from the holding exhibits a substantially straight line through any transverse section thereof across the grain direction and the stiffness of the veneer sheet against transverse bending is enhanced. In addition, the veneer sheet which has been held in a longitudinally-bent state for hours springs back or partially returns toward its original shape because of the elastic recovery of the veneer sheet upon being released from the holding. When such veneer sheet is placed on a flat surface, it becomes substantially flat by its own weight only or it has one or both of the end portions thereof bent only to a slight extent that will not hamper the smooth conveying of the veneer sheet.

In a preferred embodiment of the invention, the veneer sheet is bent with the opposite longitudinal end portions thereof curved upward so that the spaced distance between an imaginary plane connecting the opposite longitudinal ends of the veneer sheet and the surface of the veneer sheet facing the imaginary plane as measured perpendicularly to the imaginary plane is increased toward the longitudinal center of the veneer sheet.

Alternatively, the veneer sheet may be bent with the opposite longitudinal end portions thereof curved in opposite directions, or bent with one longitudinal half of the veneer sheet curved upward while the other half thereof curved downward.

According to the present invention, the veneer sheet is bent with such a curvature that the veneer sheet becomes substantially flat or it has only a slight residual bend by its own weight upon release of the holding and the holding is maintained for such a period of time that the veneer sheet is cooled substantially to the ambient temperature.

In actual practicing of the present invention, a number of veneer sheets will be held simultaneously. For this purpose, plural veneer sheets are disposed one on another in the form of a stack with the grains thereof oriented in the same direction and the veneer sheets of the stack are bend simultaneously in such way that at least a part of each veneer sheet in the longitudinal section thereof along the grain direction is curved and each veneer sheet in any transverse section thereof perpendicular to the grain direction is substantially straight, and the veneer sheets of the stack are held in the bent state for a predetermined period of time.

Features and advantages of the present invention will become more apparent to those skilled in the art from the following description of preferred embodiments of the invention, which description is made with reference to the accompanying drawings, wherein:

DETAILED DESCRIPTION OF THE EMBODIMENTS

The following will describe a preferred embodiment of a method of holding a veneer sheet according to the present invention with reference to FIGS. 1 through 6.

Figure 1:
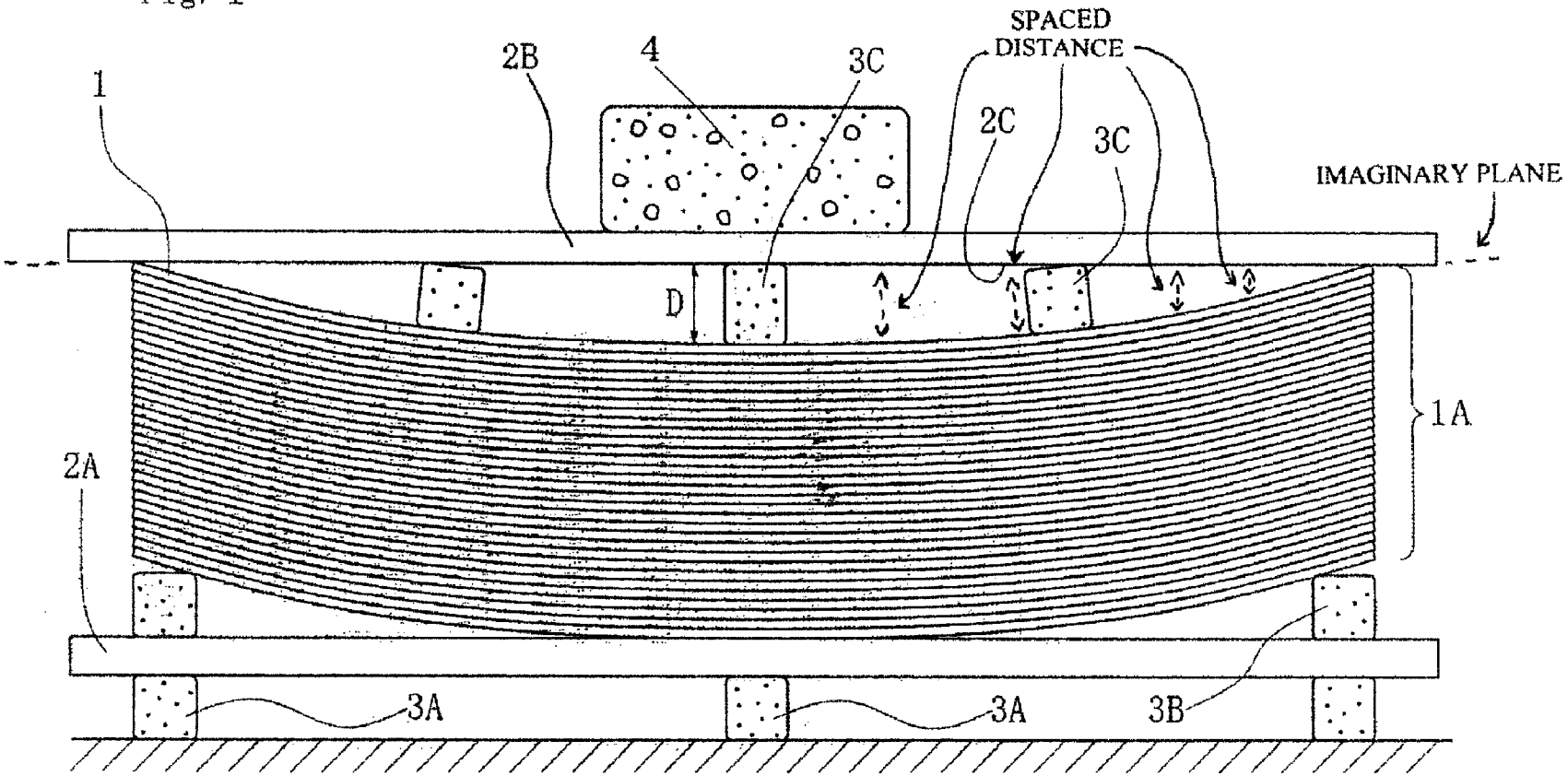
FIG. 1 is a side view illustrating an embodiment of a method of holding veneer sheets in a stack according to the present invention.
Figure 2:
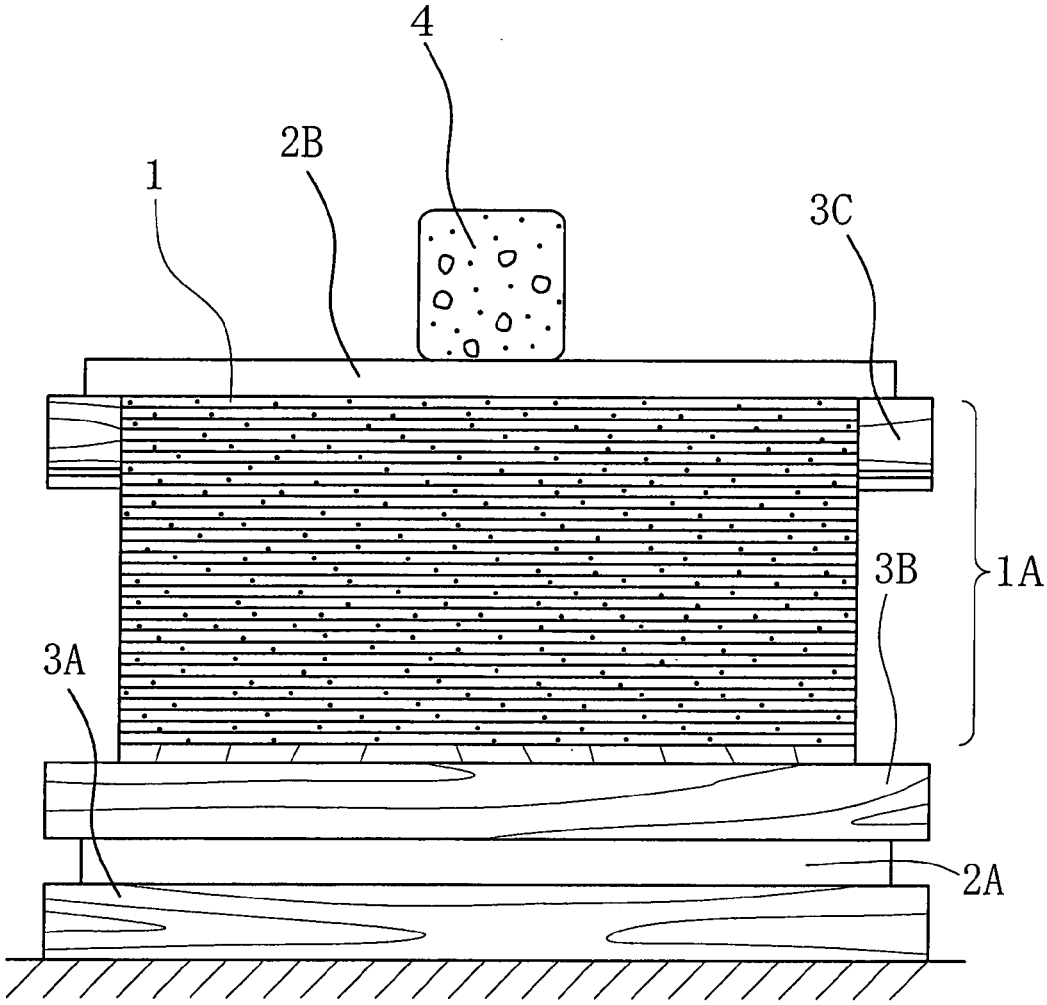
FIG. 2 is a front view of the stack of veneer sheets of FIG. 1.
Figure 3:
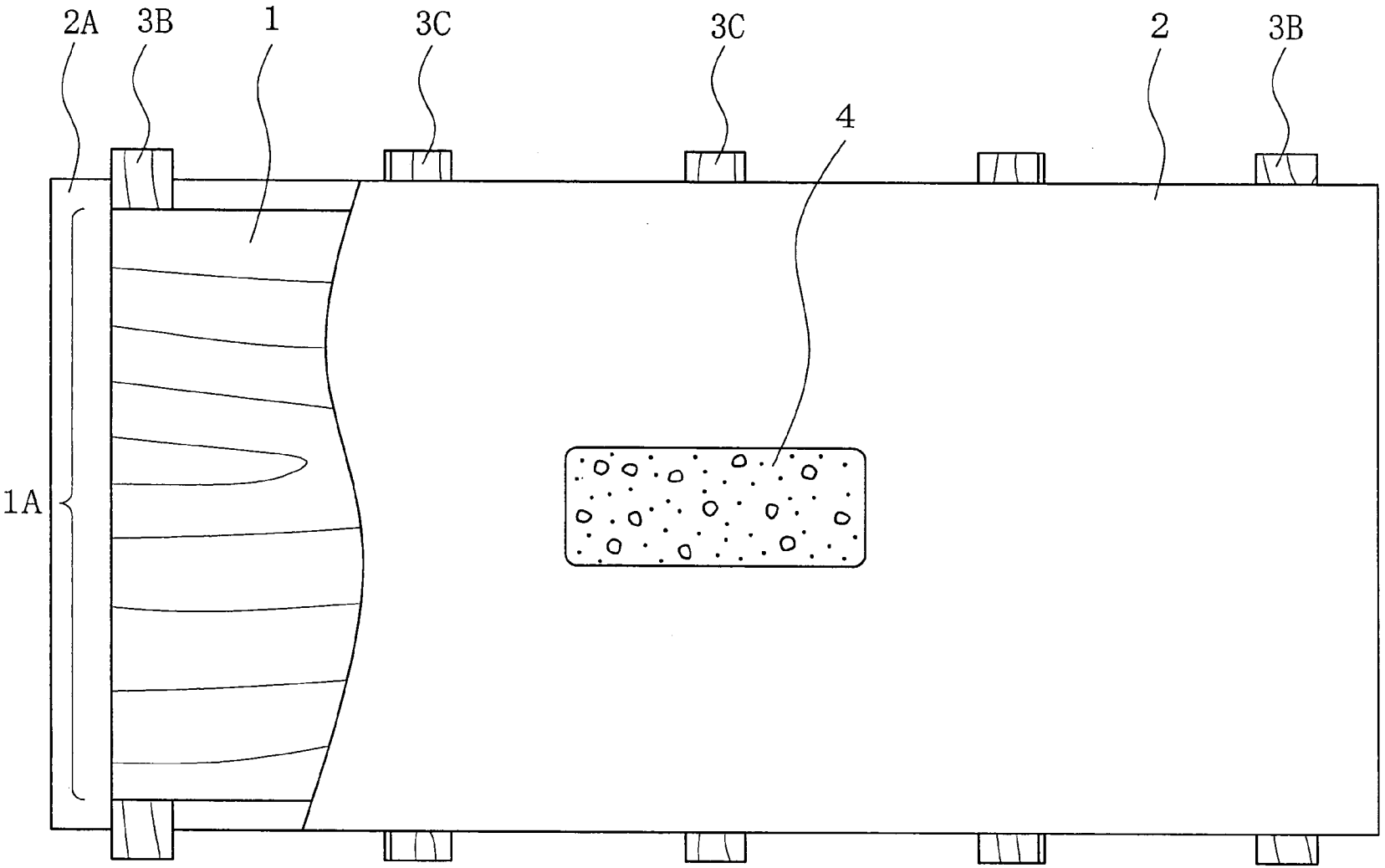
FIG. 3 is a plan view of the stack of veneer sheets of FIG. 1.

Referring firstly to FIGS. 1 through 3, there is shown a number of veneer sheets 1 which have been already dried by any suitable dryer (not shown) and still have remaining heat. The veneer sheets 1 are stacked one on another in such an orientation that the wood grains of all veneer sheets 1 are directed laterally as viewed in the drawings of FIGS. 1 and 3 and also such that any two adjacent veneer sheets disposed one on the other are laid with their facing surfaces in contact with each other over their entire areas. Incidentally, the grain direction of the veneer sheets 1 is indicated by a grain pattern of the uppermost veneer sheet 1 shown in FIG. 3. Thus, each veneer sheet 1 is disposed with its length extending laterally as seen in the drawings of FIGS. 1 and 3. A stack of such veneer sheets 1 is designated by reference symbol 1A.

As shown in FIG. 1, three elongated support blocks 3A made of, e.g., wood are arranged parallel to each other on the ground in a storage room at a suitably spaced interval along the longitudinal direction of veneer sheets 1. A support plate 2A which has a sufficient strength to resist the weight of the veneer sheet stack 1A and the bending by such weight is placed on the support blocks 3A, and two support blocks 3B similar to the blocks 3A are placed on the support plate 2A at suitably spaced positions adjacent to the opposite longitudinal ends of the veneer sheet stack 1A.

As will be readily understood, the space made between the ground and the support plate 2A is designed to receive therein working implements such as forks of a forklift truck for carrying the veneer sheet stack 1A on the plate 2A from one place to another.

The veneer sheet stack 1A is arranged on the support plate 2A with the opposite longitudinal ends thereof supported by the support blocks 3B on the support plate 2A so that the center portion of the veneer sheet stack 1A is bent downward in contact with the support plate 2A while the opposite ends are raised by the support blocks 3B, as most clearly shown FIG. 1.

In order to cause the veneer sheet stack 1A to be bent as desired, three hold-down blocks 3C are placed at any suitably spaced intervals on the top of the veneer sheet stack 1A, as shown in FIG. 1, one of which is located at the center and has a larger thickness than the other two blocks 3C located on opposite sides as measured vertically as seen in FIG. 1. A hold-down plate 2B similar in shape and structure to the support plate 2A is disposed on the hold-down block 3C and further a weight 4 made of, e.g., concrete is placed at the center on the hold-down plate 2B for causing the veneer sheet stack 1A to be bent, as shown in FIG. 1. It is noted that veneer sheets of a stack may not be bent to the desired extent depending on the species, thickness, surface condition and other factors of veneer sheets.

As a result, the veneer sheets 1 of the stack 1A are held in a bent state. Specifically, the veneer sheets 1 are held bent in such a way that each veneer sheet 1 in its longitudinal section along the grain is curved, as shown in FIG. 1, and that the same veneer sheet in its transverse section perpendicular to the grain is straight, as shown in FIG. 2. Such manner of bending will be referred to as longitudinal bending.

Double-headed arrow in FIG. 1 indicates the amount of deflection D of bend of the veneer sheet stack 1A. Specifically, the deflection D in FIG. 1 represents substantially the largest spaced distance between an imaginary plane connecting the opposite longitudinal ends of the veneer sheet stack 1A or the plane corresponding to the bottom surface of the hold-down plate 2B and the top surface of the uppermost veneer sheet 1 of the stack 1A as measured perpendicularly to the imaginary plane. It is noted that, for the sake of illustration, the double-headed arrow which indicates the largest spaced distance and, therefore, should be positioned at the longitudinal center of the veneer sheet stack 1A is shown in FIG. 1 at a position slightly spaced from the center to avoid overlapping with the center hold-down block 3C.

In the case of the present embodiment, the veneer sheets 1 are bent substantially over their entire length. The veneer sheets 1 thus bent longitudinally in the stack 1A are left as they are for hours, e.g., for about twelve hours, until the veneer sheets 1 are cooled substantially to the ambient temperature of the room in which the veneer sheet stack 1A is stored.

According to the above-described embodiment of method of holding veneer sheets, each veneer sheet 1 in the stack 1A is bent longitudinally or it is bent such that its longitudinal section along the grain is curved while its transverse section across the grain is straight. By so holding, the veneer sheet 1 after being released from the holding exhibits a substantially straight line through any transverse section thereof across the grain direction and the stiffness of the veneer sheet 1 against transverse bending is enhanced. Veneer sheets 1 thus having very little transverse bend can be laid one on another with a high accuracy and then glued together without forming any gap or overlapped part in the laminated product in the operation of the subsequent processes.

Figure 4:
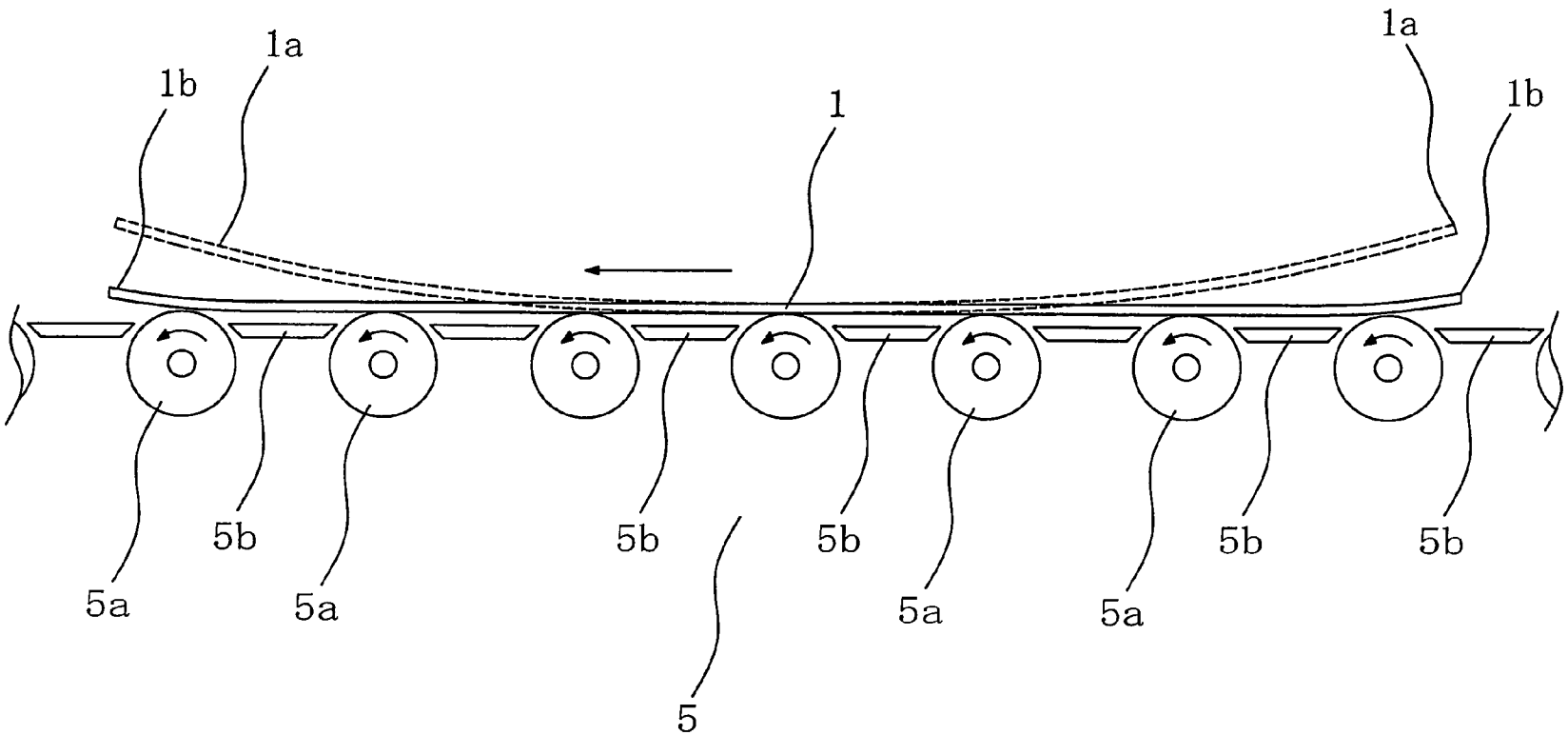
FIG. 4 is a fragmentary side view showing a roll conveyer and a veneer sheet being moved by the conveyer.
Figure 11:
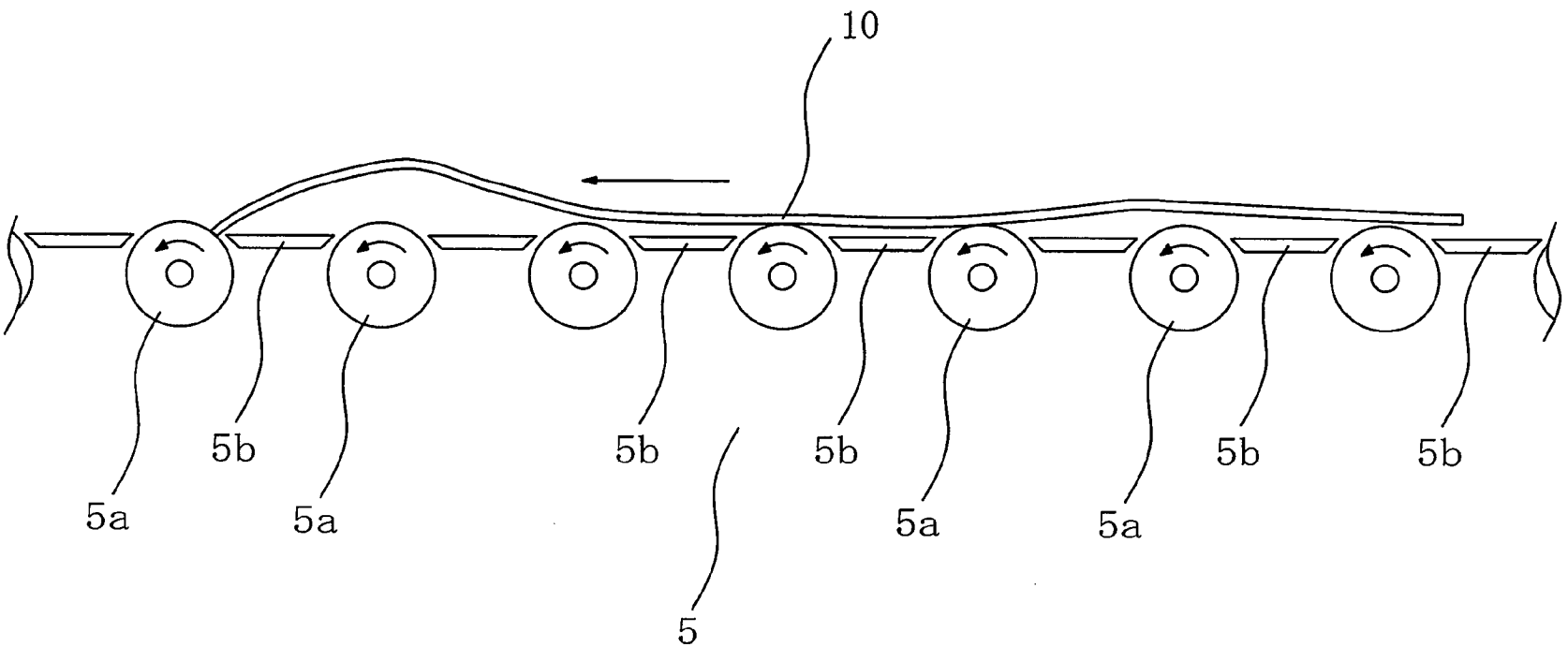
FIG. 11 is a fragmentary side view of a roll conveyer and a veneer sheet being moved by the conveyer for describing the background of the present invention.

A veneer sheet 1 which has been held in a longitudinally-bent state for hours springs back or partially returns toward its original shape because of the elastic recovery of the veneer sheet upon being released from the holding, but it remains longitudinally bent slightly as represented by a veneer sheet indicated by dotted line 1*a* in FIG. 4. When such veneer sheet 1 is placed on a roller conveyer 5 (substantially the same conveyer as that shown in FIG. 11) with its grain oriented parallel to the direction in which the veneer sheet 1 is to be moved by the conveyer 5 and also in the same position as it was while being held in the stack 1A (or the position in which the opposite longitudinal end portions are raised upward as indicated by dotted line 1*a*) as shown in FIG. 4, the veneer sheet 1 is substantially flattened by its own weight as indicated by solid line 1*b*.

Therefore, the veneer sheet 1 being moved in arrow direction (FIG. 4) by the conveyer 5 is much less susceptible to the influence of air resistance, so that its tendency of turning aside from a straight course of the conveyer 5 and thereby hitting against part of the conveyer 5 is greatly reduced. As a result, the veneer sheets 1 can be moved by the conveyer 5 with greater smoothness and stability and a failure in conveying veneer sheets as described earlier with reference to FIG. 11 will not occur.

Figure 5:
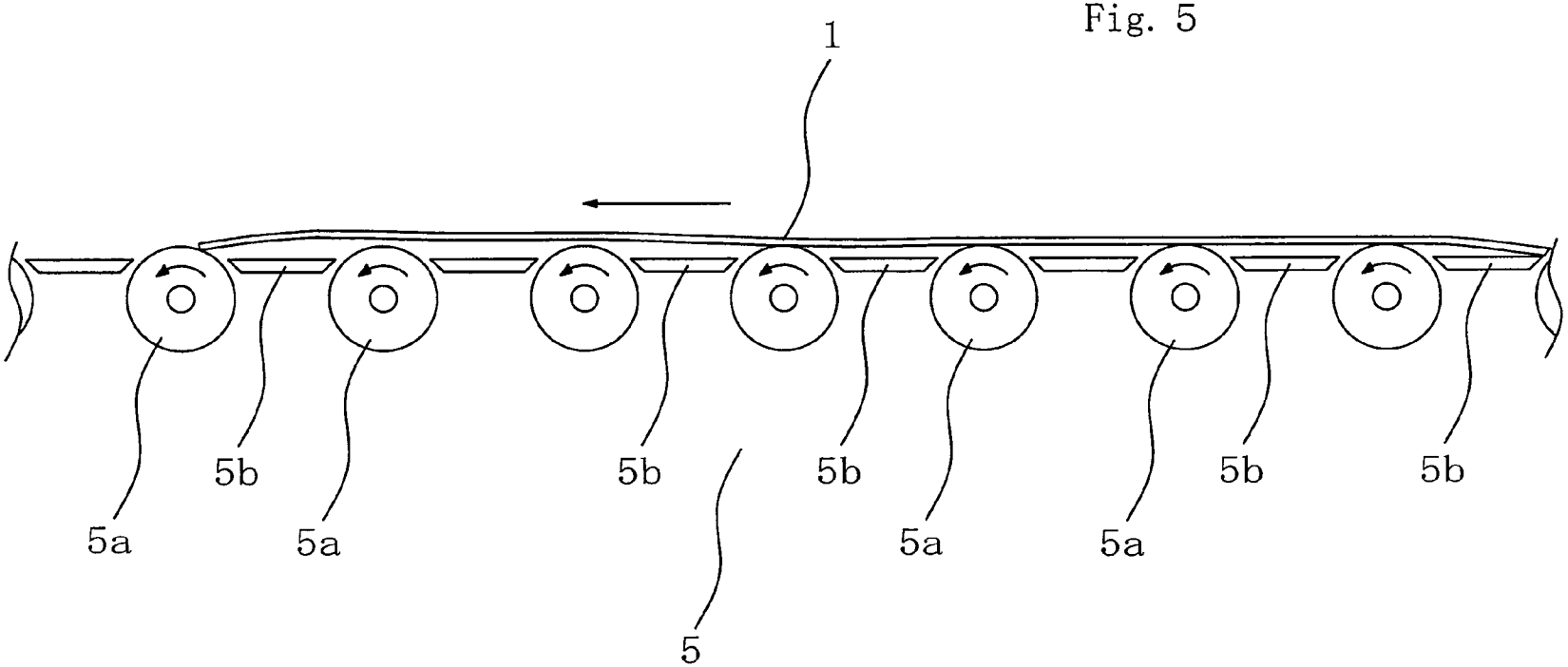
FIG. 5 is another fragmentary side view showing the roll conveyer of FIG. 4 and a veneer sheet being moved by the conveyer.

On the other hand, when a veneer sheet 1 is placed on the conveyer 5 in a reversed position, or turned upside down as shown in FIG. 5, the veneer sheet 1 partially returns toward its original state because of its own weight. As is apparent from FIG. 5, the opposite longitudinal end portions of the veneer sheet 1 are not bent to such an extent that hampers smooth movement of the veneer sheet 1 on the conveyer 5. Specifically, the leading end of the veneer sheet 1 is not bent downward to such an extent that it is brought into harmful contact with a roller 5*a* and smooth conveying operation of the veneer sheet 1 is prevented.

Since all veneer sheets 1 in the stack 1A are held bent substantially in the same condition for hours, the residual bend after release of the holding as represented by the veneer sheet 1*a*, 1*b* in FIG. 4 is substantially common to all the veneer sheets 1 of the stack 1A. Therefore, once the desired position of veneer sheet 1 in which it is to placed on the conveyer 5, that is either of the positions shown in FIG. 4 and FIG. 5, has been decided, all the veneer sheet 1 can be placed onto the conveyer 5 without troublesome work of reversing veneer sheets depending on their variable extent or direction of bend.

Figure 6:
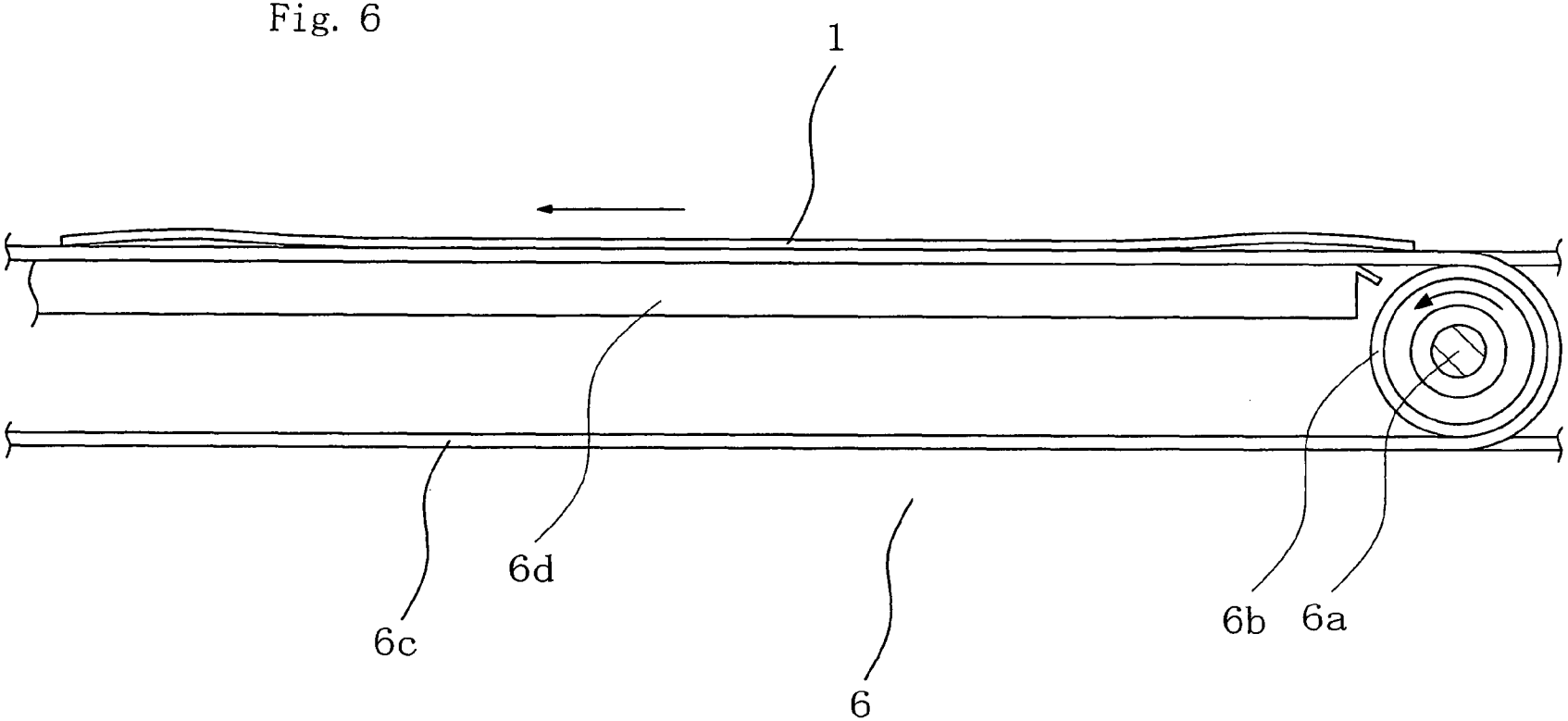
FIG. 6 is a fragmentary side view showing a belt conveyer and a veneer sheet being moved by the conveyer.

The veneer sheet 1 may be moved by a belt conveyer 6 which has an idle pulley 6*b* rotatably mounted on a pulley shaft 6*a*, a positively driven pulley (not shown), an endless belt 6*c* installed between the idle and driven pulleys and a belt support 6*d*, as shown in FIG. 6. Such a belt conveyer 6 may be used advantageously in moving veneer sheets 1 at a high speed. In the case of using such a belt conveyer, a veneer sheet 1 placed on the belt 6*c* as shown in FIG. 6, or in the same position as in the case of FIG. 5, can be moved smoothly.

The residual bend of a veneer sheet 1 occurring after release from the holding for a predetermined length of time should preferably be of such an extent that the veneer sheet 1 becomes substantially flat by its own weight when it placed on a flat surface such as the conveyer 5, as indicated by solid line 1*b* in FIG. 4. For this purpose, veneer sheet stacks should be held bent for a given length of time with various amounts of the deflection D for testing and the amount of the deflection D which has brought about the best result should be selected.

In the above-described embodiment of FIGS. 1 through 3, the veneer sheet stack 1A is held bent with the opposite longitudinal ends of the individual veneer sheets 1 curved upward. Though not shown in the drawings, the veneer sheet stack may be bent such that its intermediate portion is raised or curved upward by changing the arrangement of the support blocks 3B and the hold-down blocks 3C.

In holding a number of veneer sheets 1 each having a relatively small thickness, e.g. about 1 mm, according to the method of the present invention, the stack of such veneer sheets should be held bent with an increased amount of the deflection D because such thin veneer sheets tend to return to their original undesirable shapes upon release of the holding if they are bent with the same amount of the deflection D as in the cases of FIGS. 1 through 3. However, increasing the deflection D will increase the apparent height of the veneer sheet stack, thereby increasing the tendency of the stack interfering with surrounding objects in the veneer storage room when the stack is being moved for transportation in the room or requiring a larger space for storage of the stack.

Figure 7:
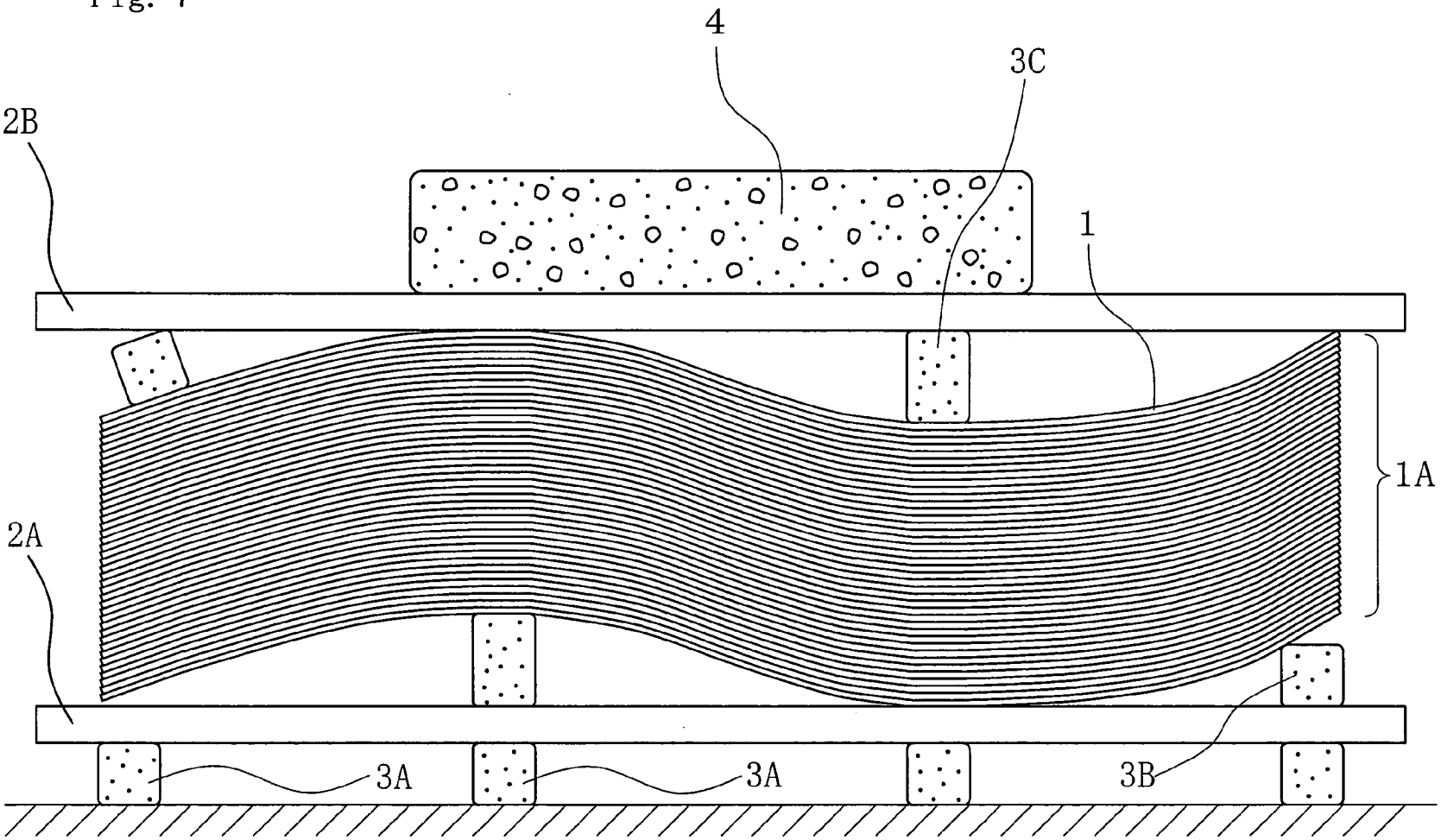
FIG. 7 is a side view illustrating another embodiment of the method of holding veneer sheets in a stack according to the present invention.

Such a problem may be overcome by holding the veneer sheet stack 1A as in FIG. 7 which shows another embodiment of the method according to the present invention. According to this embodiment, the support blocks 3B and the hold-down blocks 3C are so arranged that the intermediate portion of the left half of the stack 1A as viewed in FIG. 7 is bent upward, while the intermediate portion of the right half of the stack 1A is bent downward. By so holding, the stack 1A of thin veneer sheets 1 is bent with a smaller radius of curvature and hence with a larger deflection D than in the case of the above first embodiment of FIG. 1 for substantially the same overall height of the veneer sheet stack 1A. Upon release of the holding, the thin veneer sheets 1 can have a residual bend of the desired magnitude and direction. As described earlier, the amount of the deflection D in holding the veneer sheet stack may be determined according to the results from testing of holding the stack with various amounts of the deflection D for a given length of time.

Figure 8:
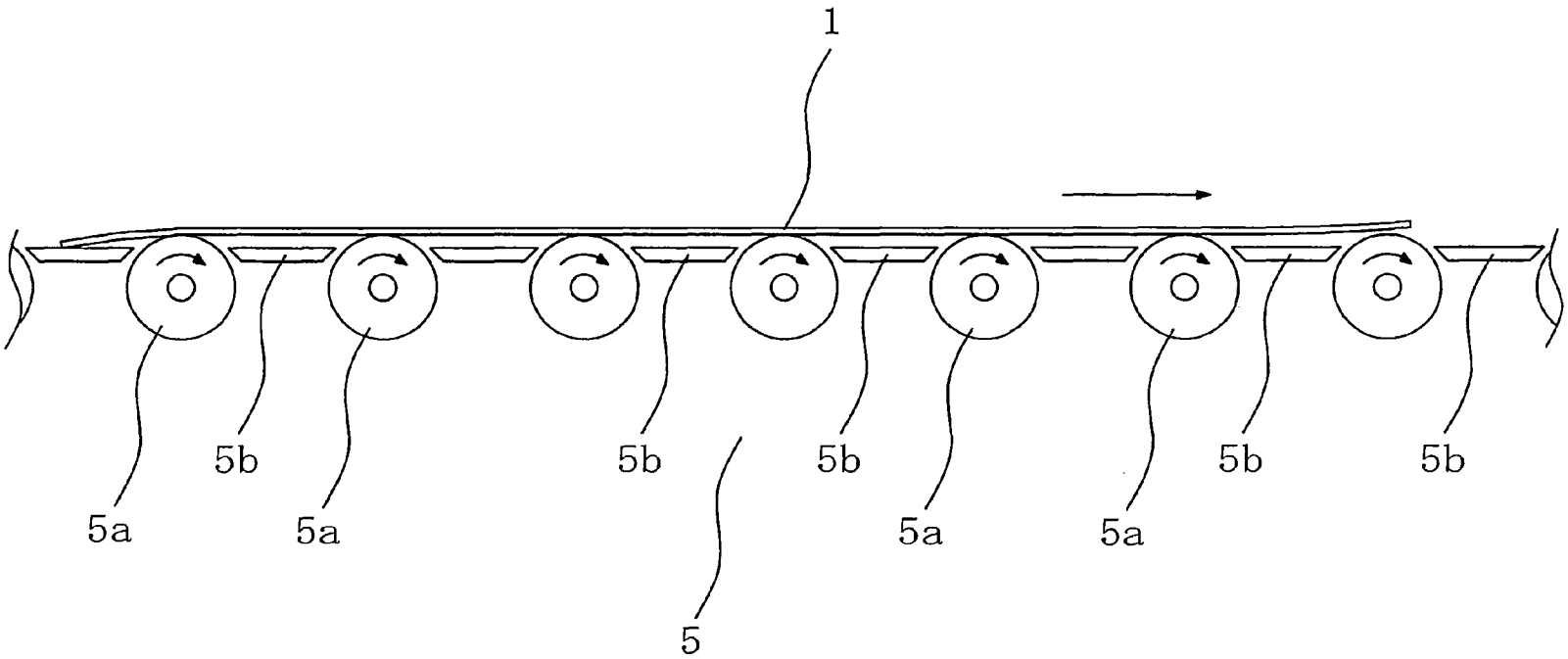
FIG. 8 is a fragmentary side view showing a roll conveyer and a veneer sheet being moved by the conveyer.
Figure 9:
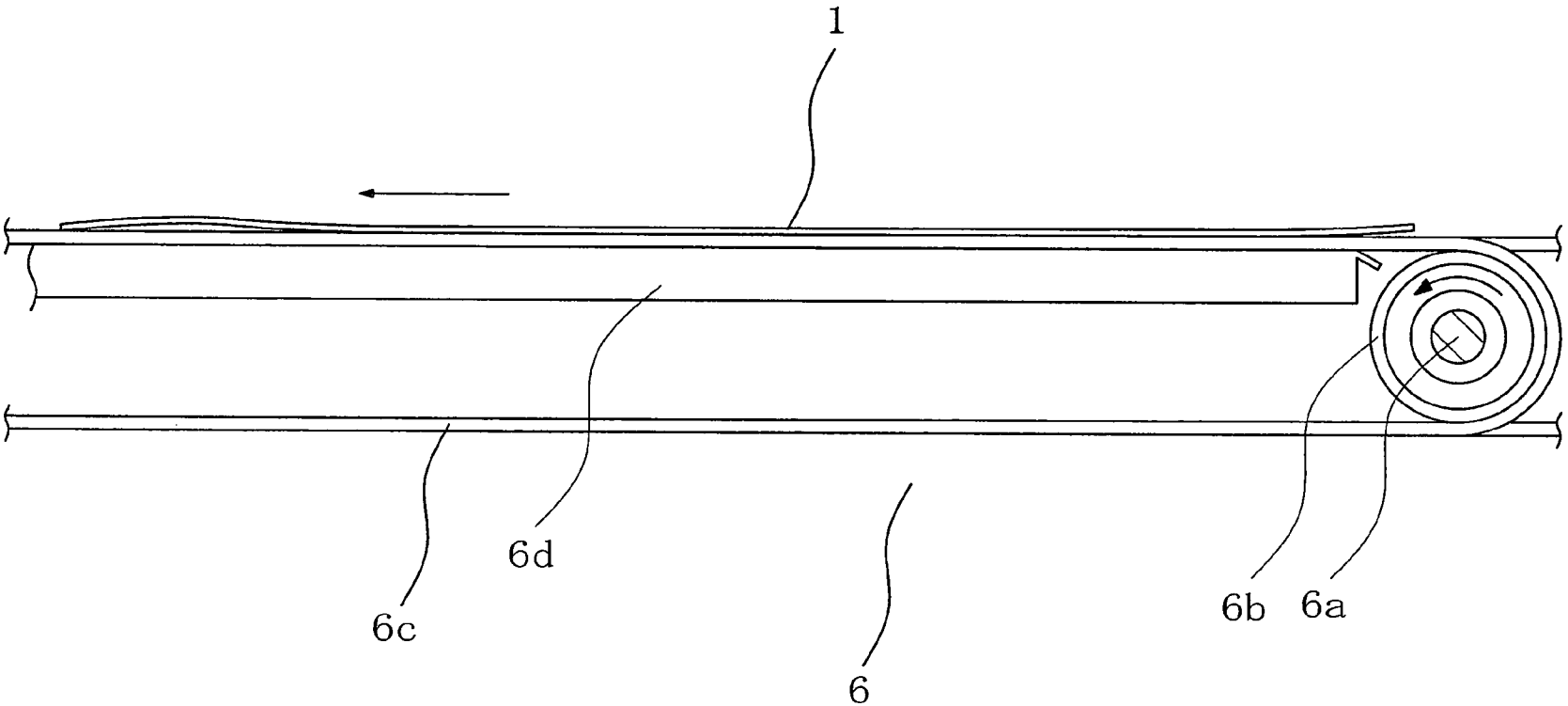
FIG. 9 is a fragmentary side view showing a belt conveyer and a veneer sheet being moved by the conveyer.

The thin veneer sheets 1 released from the holding according to the embodiment of FIG. 7 may be placed on the roller conveyer 5 or on the belt conveyer 6 and moved in arrow directions as shown in FIGS. 8 and 9, respectively.

Figure 10:
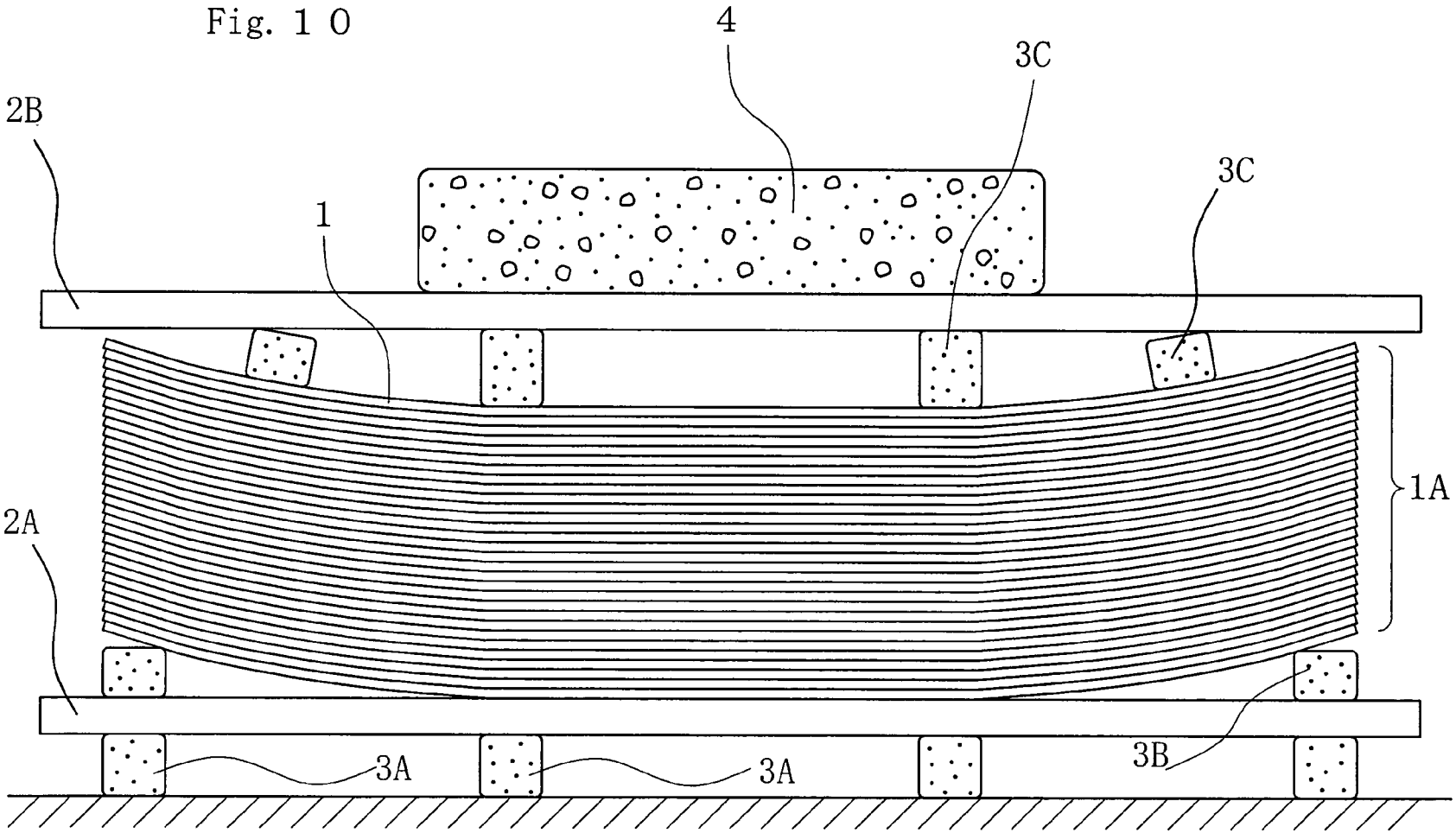
FIG. 10 is a side view illustrating still another embodiment of the method of holding veneer sheets in a stack according to the present invention.

In the foregoing two embodiments, the veneer sheets 1 in the stack 1A are held bent such that each veneer sheet 1 is curved over its entire length along the grain. According to the invention, however, the veneer sheet 1 may be bent and held with only part of the veneer sheet 1 curved longitudinally, as exemplified in FIG. 10, wherein only the opposite longitudinal end portions of each veneer sheet 1 are bent upward by using a heavier weight 4 which forces the middle portion of the stack 1A against the support plate 2A so that a part of the longitudinally intermediate portion is caused to be flat as shown in the drawing. When the veneer sheets 1 of the stack 1A of FIG. 10 are released from the holding, the longitudinal end portions of each veneer sheet 1 become substantially flat only with a slight residual bend as described earlier with reference to the embodiment of FIGS. 1 through 3. Alternatively, the veneer sheet 1 may held bent so that it has the desired residual bend in the desired direction. Waves or transverse bending in the longitudinally central portion of each veneer sheet 1 are removed and the intermediate portion thereof is flattened by the heavier weight 4.

The following will show some examples of modified embodiments of the present invention and also some considerations to be taken in practicing the present invention.

The period of time during which the veneer sheets are held in a bent state may be determined depending on the temperature of veneer sheets. Specifically, veneer sheets which have been dried by hot air of about 180° C. in a dry kiln and taken out therefrom are still hot and the heat of the veneer sheets piled one on another in the form of a stack is difficult to be dissipated and, therefore, it takes a long time, e.g. a couple of hours to half a day, for such veneer sheets to be cooled down to a level that is appropriate for joining by adhesive. According to the experiment we conducted, the period of time in the above range is sufficient for the longitudinal end portions of a veneer sheet to become substantially flat or to have a slight curve in the desired direction. Generally, the veneer sheet should be held bent until its temperature is reduced to about the ambient temperature of a place where the veneer is stored for holding.

The temperature at which veneer sheets are held bent is variable depending on the type of dryer used for drying of the veneer sheets and, therefore, the period time during which veneer sheets should be held in a bent state should also be variable. For establishing the length of time for holding the veneer sheets according to the present invention, the veneer sheets should be held bent for various lengths of time for testing and the time according to which the best results have been achieved may be set as the working period of time for holding veneer sheets.

Veneer sheets to be held according to the present invention need not to be such veneer sheets that have just dried and still have residual heat. Veneer sheet for the holding may be left in the atmosphere or in a room for hours to be cooled down to the ambient temperature for some reason and then heated before the holding. That is, the veneer sheet to be held according to the present invention should be such a veneer sheet that has been dried to a moisture content below the fiber saturation point and heated to a level that is higher than the ambient temperature.

It is noted that the arrangement for bending veneer sheets as shown in FIGS. 1-3, 7 and 10 is provided just as an example and any specific arrangement or device may be made and prepared for bending and holding the veneer sheet stack.

Though the foregoing description has been directed to holding a number of veneer sheets prepared in the form of a stack, a single veneer sheet may be held bent in the same manner. In such a case, because the heat can be dissipated from the veneer sheet in a shorter time, the veneer sheet should be bent with a larger amount of the deflection than in bending a stack of veneer sheets and the optimum deflection should be determined based on any appropriate testing.

In the foregoing embodiments, veneer sheets are held with both longitudinal end portions thereof bent either in the same direction or in opposite directions, but only one longitudinal end portion, i.e. the end portion which will be used as the leading end in conveying of the veneer sheet, may be held bent.

What is claimed is:

1. A method of holding a veneer sheet stack such that any two adjacent veneer sheets are disposed one on the other with facing surfaces in contact with each other over their entire area, where each veneer sheet has a length along the grain direction thereof and a width transverse to said grain direction and has been dried to a moisture content lower than the fiber saturation point and also heated to a temperature higher than an ambient temperature of an environment where the veneer sheet is held, comprising:

bending the higher than ambient temperature stack of veneer sheets in a bent state in such way that at least a part of the each veneer sheet of the stack in the longitudinal section thereof along said grain direction is curved and each veneer sheet of the stack in any transverse section thereof perpendicular to said grain direction is substantially straight; and holding the veneer sheet stack in said bent state for a predetermined period of time, until each veneer sheet of the stack is cooled to substantially ambient temperature.

2. A method of holding a veneer sheet stack according to claim 1, wherein each veneer sheet is bent with the opposite longitudinal end portions thereof curved in the same direction so that the spaced distance between an imaginary plane connecting the opposite longitudinal ends of the veneer sheet and the surface of the veneer sheet facing the imaginary plane as measured perpendicularly to the imaginary plane is increased toward the longitudinal center of the veneer sheet stack.

3. A method of holding a veneer sheet stack according to claim 2, wherein the stack of veneer sheets is bent over the entire length thereof so that said spaced distance is largest substantially at the longitudinal center of the stack of veneer sheets.

4. A method of holding a veneer sheet stack according to claim 2, wherein the stack of veneer sheets is bent so that a part of longitudinally intermediate portion of the veneer sheet stack is substantially flat.

5. A method of holding a veneer sheet stack according to claim 1, wherein the stack of veneer sheets is bent with the opposite longitudinal end portions thereof curved in opposite directions.

6. A method of holding a veneer sheet stack according to claim 1, wherein the stack of veneer sheets is bent with such a curvature that each veneer sheet becomes substantially flat by its own weight when the veneer sheet stack is released from the holding and placed in its horizontal position.

7. A method according to claim 1, wherein the veneer sheet stack is bent with such a curvature that the opposite longitudinal end portions of each veneer sheet remains curved slightly by its own weight in the same direction in which said longitudinal end portions have been curved during the holding when the veneer sheet stack is released from the holding and placed in its horizontal position.

8. A method of holding a stack of veneer sheets such that any two adjacent veneer sheets are disposed one on the other with facing surfaces in contact with each other over their entire area, wherein said stacked veneer sheets are disposed one on another in the form of a stack with the grains thereof oriented in the same direction and each veneer sheet has a length along the grain direction thereof and a width transverse to said grain direction and has been dried to a moisture content lower than fiber saturation point and heated to a temperature higher than an ambient temperature of an environment where the veneer sheet stack is held, comprising:

bending the higher than ambient temperature stack of veneer sheets in a bent state in such way that at least a part of each veneer sheet in the longitudinal section thereof along said grain direction is curved and each veneer sheet in any transverse section thereof perpendicular to said grain direction is substantially straight; and holding the stack of veneer sheets in said bent state for a predetermined period of time, until the veneer sheets are cooled to substantially ambient temperature.

* * * * *